United States Patent [19]

Bodnar

[11] Patent Number: 4,793,113

[45] Date of Patent: Dec. 27, 1988

[54] WALL SYSTEM AND METAL STUD THEREFOR

[76] Inventor: Ernest R. Bodnar, 53 Pheasant Lane, Islington, Ontario, Canada, M9A 1T5

[21] Appl. No.: 61,038

[22] Filed: Jun. 12, 1987

Related U.S. Application Data

[63] Continuation of Ser. No. 908,958, Sep. 18, 1986, abandoned.

[51] Int. Cl.[4] ..... E04B 2/42

[52] U.S. Cl. ..... 52/481; 52/636; 52/634; 52/739; 52/727

[58] Field of Search ..... 52/690, 696, 739, 634, 52/636, 84, 481; 403/403, 281, 376, 727, 737

[56] References Cited

U.S. PATENT DOCUMENTS

| | | | |
|---|---|---|---|
| 1,516,480 | 11/1924 | Whiteemore | 52/634 |
| 1,799,337 | 4/1931 | Warhus | 52/634 |
| 2,233,969 | 3/1941 | Woods | 244/123 |
| 2,567,124 | 9/1951 | Roberts | 244/124 |
| 3,381,439 | 5/1968 | Thulin, Jr. | 52/643 |

FOREIGN PATENT DOCUMENTS

| | | | |
|---|---|---|---|
| 496009 | 7/1919 | France | 244/123 |

*Primary Examiner*—Carl D. Friedman
*Assistant Examiner*—Carloline D. Dennison

[57] ABSTRACT

A wall having metal wall studs in parallel spaced-apart relation, and each, in turn, having two parallel angles each defining a panel supporting flange, to which wall panels may be attached, and each further defining a bracing strip, integral with the panel supporting flange, at right angles thereto, a plurality of straps integral with the angles each strap defining an axis extending diagonally between the bracing strips and defining generally triangular openings with their apeces directed alternately in opposite directions, generally triangular widened roots on each end of the strap, a plurality of transverse ribs in the panel supporting flanges normal to the right angle junctions between the bracing strips and the panel supporting flanges, and further transverse ribs in the bracing strips and extending into the triangular enlarged roots, the first and second transverse ribs being formed in aligned pairs and meeting and joining one another at the right angle junction, wall panelling on the panel supporting flanges on one side, and screws passing through the panelling and secured in the panel supporting flanges.

1 Claim, 2 Drawing Sheets

WALL SYSTEM AND METAL STUD THEREFOR

This application is a continuation of Application Ser. No. 908,958 filed Sept. 18, 1986, abandoned.

The invention relates to a wall system employing structural members formed of sheet metal for use in buildings, and in particular to the for bearing and non-loadbearing walls and partitions, in buildings.

BACKGROUND OF THE INVENTION

Construction makes use of studs either of wood or metal. Metal studs are greatly preferred in many forms of construction, since they are resistant to termites, rot and fire damage. Metal studs are lighter than wooden studs, of equal strength, and are thus suitable for non-loadbearing walls and partitions in commercial buildings. In high rise buildings they are preferred, or even required by architects and engineers, in order to avoid excessive weight in the building.

Metal studs support wall covering materials and are frequently used in association with panels of drywall material. Walls also carry services such as wiring, and the like.

It is desirable that the walls shall readily pass services to and fro without obstruction.

In any metal stud it is desirable to reduce the effects inherent in the use of metal, such as transfer of heat, and transfer of sound. Heat loss is a significant problem in exterior walls. Various proposals have been made to provide studs for exterior walls, in which the path for heat transfer has been reduced by forming openings in the stud.

In interior walls, the studs should be as free as possible from sound transfer. It is also desirable that they shall be as rigid as is required to maintain the panels in position, and also to be as light as possible.

In the past, typical metal drywall studs involved a generally three sided channel section having a central web and two side walls, bent into a channel shaped cross-section. This section was continuous along the length of the studs.

These studs have been widely used in the past and have proved satisfactory in many cases. There are however various disadvantages which arise from this particular design. In the first place the central web is generally speaking a continuous barrier throughout the height of the wall. Consequently, it is necessary to puncture the web in order to pass wiring through it. This tends to leave relatively sharp edges, and also involves a certain amount of time consuming work in punching the holes.

Another disadvantage is the fact that unless such studs were made of extremely thin gauge metaal, they tended to be unecessarily heavy, and costly for the job to be done.

In order to overcome some of these problems the studs were in some cases designed with service openings. However, these tended to weaken the stud and make it less rigid, and such holes could only be opened up in a very restricted manner.

In addition, it is desirable if possible to have a stud which has the same overall dimensions as a regular 2×4 stud. However, for reasons of economy and the like, it has been the practice to reduce the width of the web of the metal stud, so that the end result was a wall which was somewhat thinner than was the case using wooden studs.

This tended to increase the sound transfer through the walls. In addition, the existence of a continuous metal web extending from one side of the wall to the other tended to assist in transferring sound.

A further and more serious disadvantage arose during installation of the drywall. When the drywall is installed on such metal studs, the workman uses an electrical screwdriver similar to a power drill, and a self boring screw. The screw has a particular form of self boring screw point which is intended to be applied directly to the sheet metal of the stud, and to pierce its own hole through the stud, after which it will tighten up and secure the drywall panel to the stud. These screws have proved most satisfactory. However, where the thickness of the sheet metal in the metal stud is reduced, for reasons of economy, the side wall of the stud become relatively flexible. As a result, when the drywall workmen are inserting the screws, as they press the screw point against the side wall of the stud the side wall tends to flex. This then allows the screw to slip to one side, consequently damaging the drywall, and leading to a slow down in work. As a result, the thinner gauge drywall studs of this type have caused various problems.

Clearly however, it is desirable as far as possible to reduce the thickness of the gauge of sheet metal used in such studs, providing the disadvantages listed above can be avoided.

BRIEF SUMMARY OF THE INVENTION

With a view to overcoming the foregoing disadvantages, the invention comprises a wall system employing light, weight structural metal wall members, formed of thin gauge sheet metal, and having two parallel spaced apart generally L-shaped angled members extending parallel to one another, a plurality of spaced apart strut members extending integrally from one said angle member to the other, and defining openings therebetween, edge flange formations formed on the said strut members, whereby said strut members have a generally channel shape in cross-section along their length, generally triangular enlarged root portions on each end of said strut members where the same join said L-shaped members, each of said L-shaped members defining parallel spaced apart panel attaching flanges, lying in general parallel spaced apart planes, to which wall covering materials may be attached, and, a plurality of indented rib formations formed transversely of said L-shaped angle portions, said ribs being formed in said wall facing flanges, and in adjacent portions of said L-shaped angle members, said ribs being formed at spaced apart intervals along the length of said L-shaped members, whereby to resist flexing of said facing flanges wall panelling overlying said panel supporting flange on at least one side of said stud members, screw fastening means extending through said wall panelling at spaced locations and passing through and secured in said panel supporting flanges.

More particularly, it is an objective of the invention to provide such a structural member wherein the sheet metal around the edges of such openings is formed into a continuous wall for increased strenth, and wherein further indentations are formed at the roots of such strut members.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
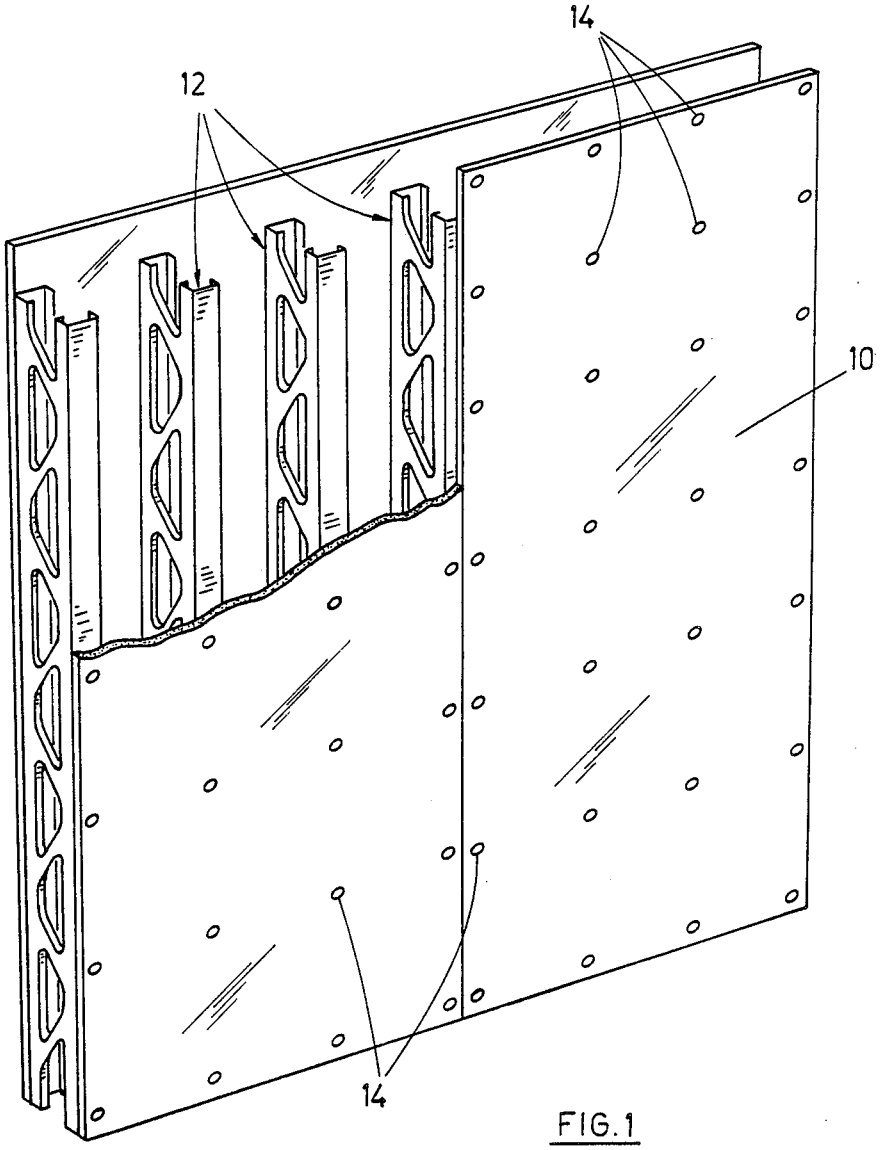
FIG. 1 is a perspective illustration of a portion of a typical wall, partially cut-away to reveal the structural members according to the invention.

Referring first of all to FIG. 1 it will be seen that a typical non-load bearing wall comprises panels of wall covering material, typically plasterboard or dry wall materials, indicated as panels 10, supported on spaced-apart vertical metal stud members indicated generally as 12. The stud members 12 in this embodiment will typically be spaced apart at intervals of sixteen inches, assuming that the panel 10 has a standard dimension of four feet by eight feet. In some wall systems the studs may be further apart or closer together, and in any event this is well known in the art and forms no part of the invention.

In a typical wall system, there will be top and bottom plate members (not shown) which will typically be metal channel sections attached to the floor and to the fabric of the ceiling, for securing the top and bottom of each stud.

In some walls, there will also be intermediate cross members (not shown) extending between adjacent studs, midway between the top and bottom plate members for bracing the studs.

It will be, of course, well understood that the panels 10 are secured to the studs 12 by means of fastening devices typically being so-called drywall screws shown generally as 14. Such screws 14 are of significance in that they are generally formed with what is known as a self-tapping point. In a typical drywall screw a portion of such point is cut away so as to leave a sharp cutting edge.

When such a point is driven into a metal stud 12, and is rotated for example, by means of a power operated screwdriver or the like, it will pierce its own hole in the stud, and will bore its way into it, and then tighten up thereby securing the wall panel to the stud.

Normally, there would be anywhere between thirty and fifty screws per panel. It will thus be appreciated that if there is any difficulty at all in inserting the screws and causing them to pierce the panel and tighten up, it will substantially slow down the installation of the drywall and thereby increase the overall cost.

On the other hand, it is desirable to make the studs themselves of thin gauge material, so as to both save in weight, and also save in material cost.

As described above these two factors have tended to conflict with one another in the construction of studs to the point where any reduction in gauge was offset by an increasing difficulty in inserting screws.

Figure 2:
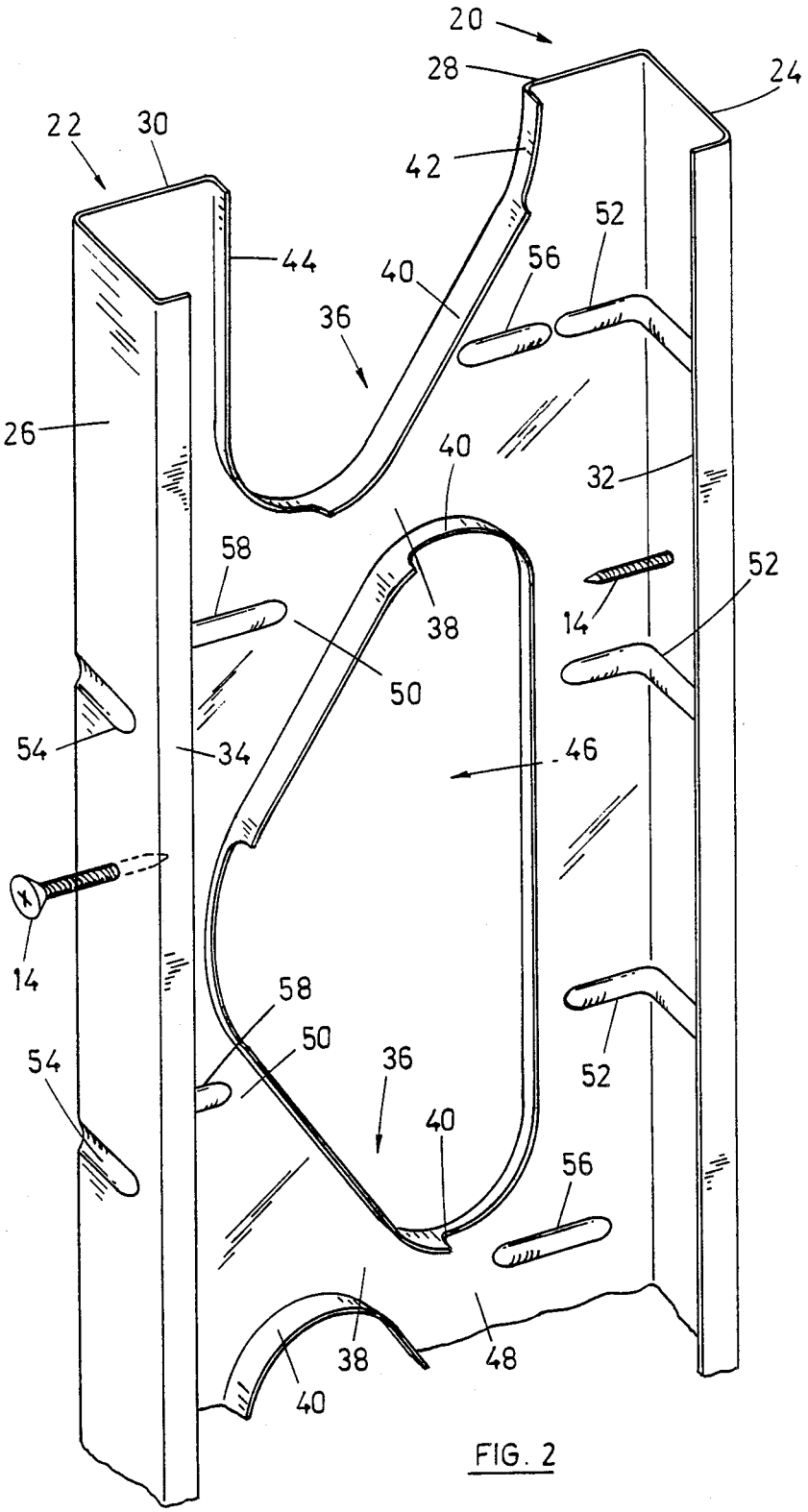
FIG. 2 is a greatly enlarged perspective illustration of the structural member of FIG. 1.

As bettwer shown in FIG. 2, the drywall stud according to the invention will be seen to comprise inner and outer generally L-shaped angle portion 20 and 22.

For the purposes of this discussion, reference will be made to inner and outer merely for the sake of differentiating between one such angle member and the other. It will, of course, be understood that in interior walls there is no such thing as an inside or an outside surface. In addition, the stud may be used either may around, or either way up, so that either side may be considered the inside or either side may considered the outside at any given moment.

Both angle portions 20 and 22 are of identical construction. They comprise facing flanges 24, 26 and side flanges 28, 30 normal thereto. The free edge of the facing flanges 24 and 26 are turned in as at 32 34. In accordance with well known practice in the art, the outwardly directed surface of the facing flanges 24 26 may be provided with a surface formation defining a plurality of small closely spaced indentations. These indentations are not shown, but in any event it is well understood that they facilitate the insertion of the screwpoint into the sheet metal, by their tendency to hold the screw point and prevent it from slipping sideways on the metal surface.

Extending between the two angle portions 20 and 22, are a plurality of generally diagonally arranged struts 36. Each of struts 36 comprises a web portion 38 and sidewall portions 40—40.

The free inward edges of the side flanges 28 and 30 are turned inwardly as at 42 44. The inturned portions 42–44 are continuous edge-wise extensions of the sidewalls 40—40 of the struts 36.

Between the struts 36, there are defined openings 46 of generally trapezoidal shape.

The roots or ends of the struts 36 are flared outwardly, as at 48 50, and thus provide a smooth transfer of forces from the angle portion 20–22, through the struts 36.

In order to increase the rigidity of the facing flanges 24–26, and often enable the gauge of the metal to be reduced, a plurality of transverse indented rib formation 52 54 are formed. The rib formations 52–54 extend in this preferred embodiment preferably in the region of the flared portion 48–50 at the end or roots of the struts 36.

Additional such ribbed formations are formed at periodic intervals along the length of the angle members 20–22.

Further ribs 56–58 are formed extending into the roots of the struts and preferably merging with ribs 52–54.

Ribs 56–58 will be formed at one stage of the manufacture. Ribs 52–54 will be formed later, after formation of the longitudinal bends in angle portions 20–22.

The operation of the invention is self-evident from FIG. 1.

Once the struts have been erected side by side at spaced intervals, the wall panel covering materials are applied and fastened by means of screws.

As the screws are pressed through the wall paneling material, against the facing flanges 24 or 26, the point of the screw will pierce the facing flange, and then pass through it, and the threads of the screw will then form their own thread, thereby causing the screw to become fastened in the facing flange.

The tendency of the facing flange 24 or 26 to become deflected under the pressure of the point of the screw, is resisted by means of the indented ribs 52 or 54, which tend to hold the facing flange 24 normal to the side flanges 28 and 30. In this way, the tendency of the screw point to skid off the surface of the flange 24 or 26 is reduced to a minimum.

It will, of course, be appreciated that if possible, any services such as electrical wiring, plumbing and the like will have been passed through the openings 46 in the studs 12, prior to the application of the wall panel.

The side flanges 28 and 30 provide a convenient means for attaching electrical service boxes for example again by means of sheet metal screws or drywall screws.

Once the wall has been covered in with wall panel, it will be appreciated that the tendency for the wall to transmit vibrations or sound is substantially reduced by the existence of the spaces 46, and the relatively small portion of metal contained in the diagonal struts 36. In this way sound transmission is reduced to a minimum.

At the same time any tendency for the struts 12 to flex is substantially reduced by the angled formations 20 and 22, being connected by means of transverse strut 36, which comprise channel sections along their length, and having sidewalls 30 merging with inturned edge portions 42 44 of the angled portions 20 and 22.

The improved rigidity inherent in a strut according to the invention enables struts to be made of thinner gauge sheet metal. This produces a saving in weight, and also a saving in material cost, without an unacceptable loss of rigidity.

By way of example, a typical Prior Art sheet metal non-load bearing stud might be formed of material in the range of 18 to 20 gauge (i.e. about 20/1,000 inch).

Non-load bearing studs as shown in FIG. 2 according to the invention may be formed of much thinner material, in the region of 25 to 30 gauge, i.e. about 15/1,000 inch, and will provide the same wall rigidity from non-load bearing walls as in the case of the regular Prior Art sheet metal stud, and will readily permit the insertion of screw fastenings in the manner described without undue flexing.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A wall comprising:

a plurality of integral one-piece structural metal wall stud members, formed of light-gauge sheet strip arranged in parallel spaced apart relation and each in turn, comprising;

two parallel spaced apart L-shaped angle portions each of said angle portion formed integrally from said metal strip and defining a panel supporting flange, to which wall panels may be attached by self-tapping screw fastening means, and each said angle portion further defining a bracing strip member, formed integrally with said panel supporting flange, and joined at right angles thereto;

a plurality of strap members formed integrally with said angle portions from said metal strip, and each strap member defining an axis extending diagonally between said bracing strip members, said strap members defining generally triangular shaped openings with rounded corners therebetween, said generally triangular shaped openings being arranged with their apexes directed alternately in opposite directions, said bracing strip members, and said web members and said triangular root portions all lying in a common plane, normal to the planes of said wall supporting flanges;

first edge flanges on each side edge of each said strap member having a predetermined depth, defining a channel-shape in cross-section along each said strap member;

further edge flanges extending completely around said openings having a predetermined depth less than said predetermined depth of said first flanges, and joining said first edge flanges at said rounded corners;

generally triangular widened roots on each end of said strap members where the same join said bracing strip members;

a plurality of first transverse linear inwardly indented ribs of a first predetermined length formed transversely in said panel supporting flanges and in said bracing strip members at spaced intervals and directed normal to and extending from said right angle junctions between said bracing strip members and said panel supporting flanges;

a plurality of second transverse linear inwardly indented ribs formed transversely in said panel supporting flanges and in said bracing strip members at spaced intervals between said first transverse linear ribs and extending across said panel supporting flanges and said bracing strip members and directed normal to said right angle junctions between said bracing strip members and said panel supporting flanges and said second transverse linear ribs having a length greater than said first linear ribs and extending into said triangular enlarged roots along an axis lying at an acute angle to said axis of said strap member extending from said root portion, whereby to resist flexing of said panel supporting flanges;

and wherein all of said panel supporting flanges lie in a common plane;

wall panelling overlying said panel supporting flange on at least one side of said stud members; and, screw fastening means extending through said wall panelling at spaced locations and passing through and secured in said panel supporting flanges.

* * * * *